United States Patent [19]

Mourier

[11] Patent Number: 4,571,524

[45] Date of Patent: Feb. 18, 1986

[54] ELECTRON ACCELERATOR AND A MILLIMETER-WAVE AND SUBMILLIMETER-WAVE GENERATOR EQUIPPED WITH SAID ACCELERATOR

[75] Inventor: Georges Mourier, Paris, France

[73] Assignee: Thomson-CSF, Paris, France

[21] Appl. No.: 604,818

[22] Filed: Apr. 27, 1984

Related U.S. Application Data

[63] Continuation of Ser. No. 304,826, Sep. 23, 1981, abandoned.

[30] Foreign Application Priority Data

Sep. 26, 1980 [FR] France ..... 80 20714

[51] Int. Cl.[4] ..... H01J 25/00

[52] U.S. Cl. ..... 315/4; 315/5; 315/5.41; 315/5.42; 372/2; 331/82

[58] Field of Search ..... 315/3, 4, 5, 5.41, 5.42; 372/2; 331/82; 330/4

[56] References Cited

U.S. PATENT DOCUMENTS

| | | | |
|---|---|---|---|
| 3,398,376 | 8/1968 | Hirshfield | 315/5 X |
| 3,463,959 | 8/1969 | Jory et al. | 315/5.41 X |
| 3,887,832 | 6/1975 | Drummond et al. | 315/5.41 |
| 4,143,299 | 3/1979 | Sprangle et al. | 315/5.41 |
| 4,199,709 | 4/1980 | Alirot et al. | 315/4 |
| 4,224,576 | 9/1980 | Granatstein et al. | 315/5 |
| 4,395,656 | 7/1983 | Kosmahl | 315/5 |

*Primary Examiner*—Saxfield Chatmon
*Attorney, Agent, or Firm*—Roland Plottel

[57] ABSTRACT

An electron beam device which includes a vacuum enclosure which houses an electron gun for producing an annular beam of helically rotating electrons, an iris-loaded waveguide which is supplied with high frequency power and serves to create a high frequency electromagnetic field along the axis of the beam which has a longitudinal electric field component along the beam axis, and a resonator which abstracts high frequency energy from the beam. A coil surrounds the vacuum enclosure to provide a magnetic field of increasing strength with distance downstream in the region of the iris-loaded waveguards whereby the angular velocity of the electrons in the beam is increased with little change in the axial velocity.

8 Claims, 5 Drawing Figures

FIG_1 "PRIOR ART"
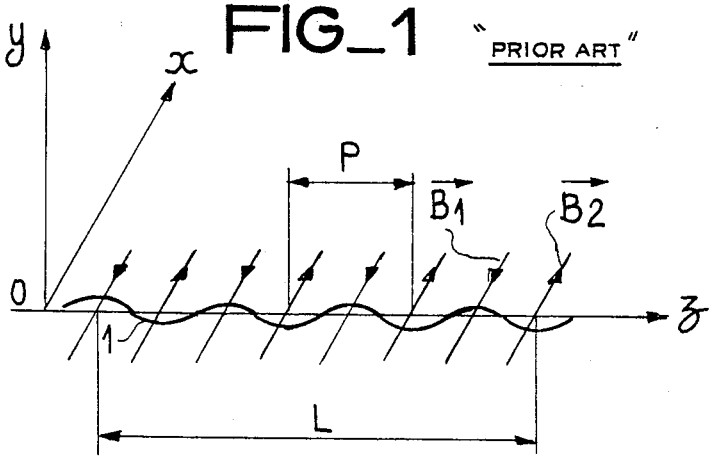
FIG_2
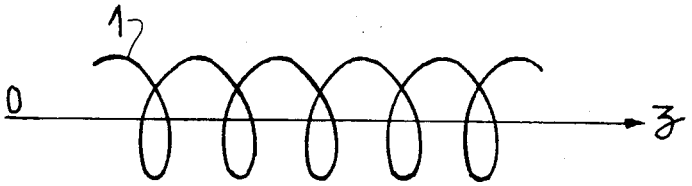
FIG_3
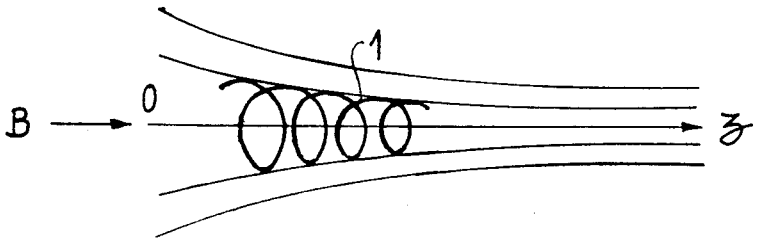

ELECTRON ACCELERATOR AND A MILLIMETER-WAVE AND SUBMILLIMETER-WAVE GENERATOR EQUIPPED WITH SAID ACCELERATOR

This application is a continuation of application Ser. No. 304,826, filed 9/23/81, now abandoned.

This invention relates to an electron accelerator which can be employed in a millimeter-wave and submillimeter-wave generator. The invention is also concerned with generators equipped with accelerators of this type.

Submillimeter-wave generators such as free-electron lasers are already known and have been described in particular in an article by L. R. Elias et Al. and published in 1976 in "Physical Review Letters", volume 36, pages 717 et seq.

In free-electron lasers, an electron beam which travels in a direction Oz at a velocity $V_z$ in the vicinity of the velocity c of light is periodically accelerated in a direction transverse to Oz.

These periodic transverse accelerations are usually obtained by producing either a helical magnetic field having a pitch P and an axis Oz or by producing two oppositely directed transverse fields perpendicular to the axis Oz and spatially distributed with the same period P.

The problem which arises in the case of lasers of this type is that the value of the period P of the transverse accelerations is governed by two contradictory requirements:

on the one hand, the frequency $\nu$ of the radiation emitted along the axis Oz by the electrons which are periodically accelerated in a direction transverse to Oz is inversely proportional to the period P since it is written:

$$\nu = \frac{V_z}{P} \cdot \frac{1}{1 - \frac{V^2}{c^2}}$$

It is therefore an advantage to choose a value P which is as low as possible in order to increase the frequency;

on the other hand, the power radiated by the electrons is proportional to the square of the transverse accelerations. In order to obtain high accelerations, magnetic fields of high intensity must be available. In order to produce these magnetic fields, the period P must be of high value in order to make it materially possible to accommodate the conductors which produce these magnetic fields. As a consequence, it is an advantage to choose a value P which is as high as possible in order to increase the radiant power.

When making use of free-electron lasers, frequencies of a few tens of gigahertz and an alternating magnetic field having an amplitude of a few teslas can be obtained simultaneously only on condition that they are considerably increased in length, which is a drawback. Furthermore, lasers of this type have low efficiency and the radiant power remains of a low order.

An electron accelerator and a generator equipped with said accelerator in accordance with the invention are based on a concept which is different from that of any known design of the prior art.

The generator in accordance with the present invention makes it possible to obtain simultaneously a high frequency and a high radiant power while maintaining dimensions which are similar to those of standard electron tubes.

Thus, in the case of a tube having a length of 1 to 2 m along the line Oz, frequencies of approximately 300 GHz can be attained with a beam of 2 to 3 MeV.

This generator has high efficiency of the order of 50% and a radiant power of 7.5 KW is obtained with a current of approximately 10 mA in the cathode-anode bias circuit.

A further advantage of this generator lies in the fact that it does not call for a very high direct-current voltage (approximately 200 KV between anode and cathode) and that the value of said direct-current voltage can vary over a wide range.

This invention relates to an electron accelerator comprising an electron gun within a vacuum enclosure, the electron beam produced by said gun being propagated along an axis Oz at a velocity along said axis Oz which is substantially lower than that of light and at a non-zero transverse velocity. Said vacuum enclosure also comprises a delay line supplied by a high-frequency generator which serves to establish a longitudinal high-frequency electric field along the axis Oz. Finally, a coil surrounds the enclosure at the level of the delay line and produces a magnetic field which slowly increases along the axis Oz.

The present invention is further concerned with a millimeter-wave and submillimeter-wave generator comprising an electron accelerator in accordance with the invention.

In said generator, the electron beam penetrates into a cavity resonator which is tuned to the frequency $F_M$ corresponding to a pulsatance or angular frequency $\omega_M$ which is slightly higher than $(e/m_o)\cdot B\cdot[(W)^2/W_o]$.

The coil which surrounds the vacuum enclosure at the level of the cavity resonator produces a uniform magnetic field along the axis Oz.

As will become apparent in the following description, the electron accelerator in accordance with the present invention can be employed in millimeter-wave and submillimeter-wave generators.

The accelerator may also be employed in devices other than generators of this type.

It is worthy of note that the generator in accordance with the invention has the same applications as generators of the prior art for millimeter waves and submillimeter waves, namely radar transmission, measurement in plasma installations, separation of isotopes, and so on.

Other features of the invention will be more apparent upon consideration of the following description and accompanying drawings, wherein:

FIG. 1 shows the distribution of magnetic fields and an electron trajectory in free-electron lasers in accordance with the prior art;

FIGS. 2 and 3 show the trajectory followed by an electron at two points of the generator in accordance with the invention;

In the different figures, the same reference numerals designate the same elements but the dimensions and proportions of the different elements have not been observed for reasons of clarity.

FIG. 1 illustrates the distribution of magnetic fields and an electron trajectory in free-electron lasers in accordance with the prior art as mentioned earlier.

It is recalled that, in lasers of this type, an electron beam 1 which travels in a direction Oz at a velocity $V_z$ in the vicinity of the velocity of light is periodically accelerated in the transverse direction at right angles to the axis Oz.

To this end, two oppositely directed fields $B_1$ and $B_2$ which are transverse to the axis Oz can be established over a predetermined length L. Said fields $B_1$ and $B_2$ are distributed periodically along the length L with the same period P.

The electron beam 1 is caused by the fields $B_1$ and $B_2$ to rise and fall as shown in the figure and is therefore subjected to transverse accelerations. The electrons radiate a power which is proportional to the square of the transverse accelerations.

Figure 4:
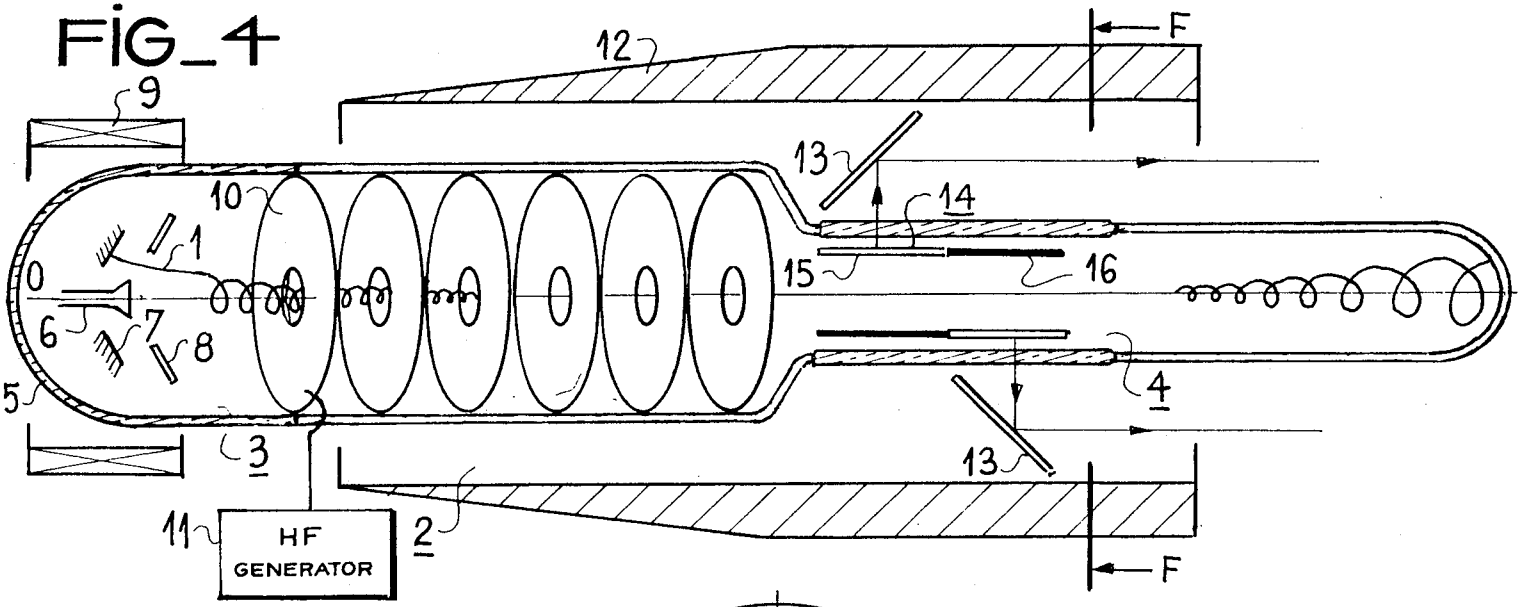
FIGS. 4 and 5 are respectively a longitudinal view along the axis Oz and a transverse view along the plane F of FIG. 4, and illustrate one embodiment of the generator in accordance with the invention.

FIG. 4 is a longitudinal view along the axis Oz showing one embodiment of the generator in accordance with the invention.

Said generator 2 is composed of two sections:

a first section 3 in which acceleration of the electron beam 1 takes place;

a second section 4 in which extraction of the millimeter and submillimeter waves takes place.

The electron accelerator 3 will first be described.

This accelerator comprises an electron gun which is placed within a vacuum enclosure 5 and produces an electron beam with a non-zero velocity in a direction transverse to the axis Oz and at a velocity $V_z$ along the axis Oz, said velocity being substantially lower than that of light. By way of example, $V_z=0.1.c$.

FIG. 2 shows the helical trajectory followed by an electron at the exit of the electron gun.

In accordance with customary practice, an electron gun of this type comprises a ring-shaped cathode 7 which produces a hollow cylindrical beam.

The general design concept of the gun is already known. Relevant information on this subject was given in particular in a thesis submitted to the Polytechnic Institute of Grenoble on July 12th, 1979 by J. L. Alirot and entitled "Injector for high-frequency wave generator of the central-injection gyrotron type".

The accelerator according to the invention may also function without using a hollow cylindrical beam but an eccentric thin beam.

In FIG. 4, there is shown diagrammatically only the cathode 7 of the electron gun and the anode in two parts 6 and 8.

The direct-current high voltage applied between the cathode and the anode is chosen so as to impart the longitudinal velocity $V_z$ to the electron beam.

A focusing coil 9 surrounds the vacuum enclosure at the level of the electron gun. At this level, the vacuum enclosure is made of insulating material consisting either of glass or ceramic material since it receives the direct-current high voltage.

Said coil 9 produces a magnetic field in the direction opposite to the field established in the remainder of the accelerator. This is necessary in order to ensure that, in the remaining portion of its travel through the accelerator, the electron beam follows a spiral path which is centered on the axis.

After the electron beam, the vacuum enclosure 5 comprises a delay line 10 which is placed along the axis Oz and supplied from a high-frequency generator 11.

Said delay line must make it possible to establish a longitudinal high-frequency electric field along the axis Oz. As a general rule, the delay line is constituted by an iris-loaded waveguide as shown in FIG. 4. Other types of delay line could be employed such as a helical line, for example.

The frequency delivered by said generator 11 is independent of the frequency delivered by the generator in accordance with the invention. As a rule, the frequency delivered by the generator 11 is much lower than that delivered by the generator in accordance with the invention and within the range of 1 GHz to 10 GHz.

As soon as it penetrates into the iris-loaded waveguide 10, the electron beam 1 is subjected to a magnetic field which increases along the axis Oz and which is produced by a coil 12.

As soon as it penetrates into the iris-loaded waveguide 10, each electron follows a spiral path which comes progressively closer to the axis Oz.

In FIG. 3, the lines of force of the magnetic field which increases along the axis are represented by thin lines; these lines of force come progressively closer to the axis Oz.

The thick line drawn in FIG. 3 shows the trajectory of an electron which follows a spiral path around a magnetic-field tube and comes closer to the axis Oz.

The increasing magnetic field makes it possible to increase the velocity of rotation of the electrons about the axis Oz. The longitudinal energy delivered by the H.F. generator 11 is converted to transverse energy, with the result that high transverse accelerations are therefore imparted to the electrons.

By way of example, the electrons may thus attain an energy equal to 4 $W_o$, where $W_o=511$ KeV is the energy of electrons at rest.

The increase in the magnetic field produced by the coil 12 along the axis Oz takes place at a low rate. By way of example, each electron follows approximately ten orbits within the iris-loaded waveguide 10.

When an electron is placed in a magnetic field having an intensity B, its rotational velocity in the plane perpendicular to the electric field is written:

$$\omega_s=(e/m_o)\cdot B\cdot(W_o/W)$$

where e is the electric charge of the electron, $m_o$ is the mass of the electron at rest, $W_o$ and W are the energies of the electron respectively at rest and in the excited state.

Each electron follows a spiral path when placed in a magnetic field which increases slowly with Oz and in an electric field having an amplitude E along the axis Oz and produced by the H.F. generator 11. The motion of the electrons from O to z has an acceleration which is written:

$$-e\,E-\frac{e\cdot C}{m}\cdot\frac{\delta B}{\delta z}$$

where C is a constant of the motion and is written:

$$C=\frac{e\cdot B\cdot r^2}{2}$$

where r is the radius of the orbital path followed by the electrons.

The energy transmitted to the electrons is derived from the electric field having an amplitude E and produced along the axis Oz by the H.F. generator 11.

The variation in energy of the electron beam from the entrance to the exit of the accelerator is given by the equation:

$$W_2 - W_1 = \int_1^2 E \cdot dz.$$

It is deduced fom this equation that the variation in energy of the beam from the entrance to the exit of the accelerator is not dependent on the variation in electron velocity $V_z$ along the axis Oz.

The velocity $V_z$ can therefore be constant along the axis Oz. The following relation must then be established between the value of the electric field having an amplitude E along the axis Oz and the variations in the magnetic field along Oz:

$$-E\left(1 - \frac{V_z^2}{c^2}\right) = \frac{C}{m} \cdot \frac{\delta B}{\delta z}$$

In order to obtain a constant velocity $V_z$, action must accordingly be produced on the increasing magnetic field produced by the coil 12.

There will be given hereinafter a numerical example corresponding to the case in which it is desired to obtain a final energy of 4 $W_o$.

Starting from the equality $W=4\ W_o$, there is obtained from the relation:

$$W = \frac{W_o}{\sqrt{I - \frac{V^2}{C^2}}}$$

the total velocity of the electrons: V=0.9682.c.

When establishing the characteristics of the electron gun and in particular the direct-current voltage between anode and cathode, the value adopted for the constant longitudinal velocity is equal to: $V_z=0.1.c$ and the value adopted for the transverse velocity is equal to: 0.9631.c.

The following values are then determined:

initial magnetic field: 1436T
final magnetic field: 3T
cyclotron frequency: $(e/2\pi m_o).B=84$ GHz
synchrotron frequency: $(e/2\pi m).B=21$ GHz
initial orbit radius: $10^{-2}$ m
final orbit radius: $0.219\times10^{-2}$ m
motion constant C: $1.149\times10^{-24}$ (S.I. units)
initial energy: $W_1=1.314.W_o$, where $W_1$ represents the electron energy at the entrance of the delay line
total acceleration energy: 1372 keV
direct-current high voltage: 160 kV
length of accelerator: $>13\times10^{-2}$ m.

In the foregoing description, consideration has been given to the first section 3 of the generator 2 in accordance with the invention in which acceleration of the electron beam 1 takes place. There will now be described an embodiment of the second section 4 of said generator in which extraction of millimeter and submillimeter waves takes place.

In this second section, the diameter of the vacuum enclosure 5 of the generator 2 is smaller than its diameter at the level of the accelerator 3.

It is thus possible to insert between said enclosure and the coil 12 two inclined mirrors 13 which may be of the metallic type, for example. Said mirrors receive the coherent radiation emitted by the electrons and reflect said radiation in a direction parallel to the axis Oz for subsequent utilization.

Figure 5:
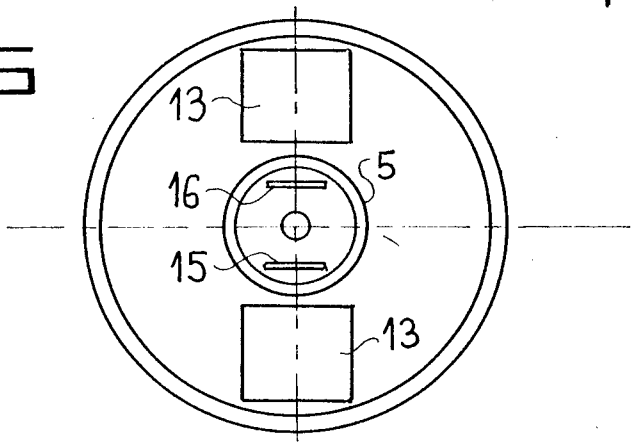

The rectangular cross-section of the mirrors 13 is shown in FIG. 5, which is a transverse view of the generator in accordance with the invention, this view being taken along the plane F of FIG. 4.

At the level of the second section 4 of the generator, the coil 12 produces a uniform magnetic field along the axis Oz.

In order that the radiation emitted by the accelerated electrons should be made coherent, the electron beam which emerges from the accelerator is passed between two parallel reflectors 14.

These two reflectors are separated by a distance equal to $N\cdot(\lambda M)/2$, where N is a whole number and $\lambda_M$ is the wavelength of the coherent radiation which is to be obtained and which will be defined in greater detail hereinafter.

Each reflector 14 has a semi-reflecting zone 15 which allows a fraction of the radiation to pass while reflecting the remainder and a reflecting zone 16. The reflecting zone of a reflector is located opposite to the semi-reflecting zone of the other reflector and conversely.

In consequence, the radiation is collected through the vacuum envelope 5 (which is of glass at that point) in two opposite directions in each zone in which the radiation is allowed to pass through the two reflectors.

The mirrors 13 serve to deflect the radiation in the direction Oz since it is not possible to allow propagation of the radiation at right angles to the reflectors by reason of the presence of coil 12.

In fact, the second section 4 of the generator in which extraction of millimeter and submillimeter waves takes place constitutes a cavity resonator which is tuned to the frequency $F_M$ corresponding to $\lambda_M$.

This cavity can be open or in other words constituted for example by two parallel reflectors as is the case in the embodiment shown in FIG. 4.

Said cavity can also be closed and constituted by a portion of waveguide, for example.

As a result of researches conducted by J. Schwinger and reported in particular in an article published in the June 15th, 1949 issue of "Physical Review", volume 75, No 12, pages 1912 to 1925, it is known that an electron of energy W which is placed in a magnetic field of intensity B rotates at the angular velocity:

$$\omega_S=(e/m_o)\cdot B\cdot(W_o/W),$$

but that its optimum radiation takes place around the harmonics of $\omega_S$: $\omega_m=K\cdot\omega_S$, with a maximum in respect of: $K\simeq(W/W_o)^3$, that is, about an angular frequency $\omega_M$ which is slightly higher than: $(e/m_o)\cdot B\cdot(W/W_o)^2$.

It is in fact known that stimulated synchrotron radiation alwyas takes place at a frequency which is very close to the frequency of the resonator and higher than the frequency of the synchrotron harmonic.

In the case of the numerical example given earlier, the wavelength $\lambda_M$ and the frequency $F_M$ have substantially the values: $\lambda_M=222\ \mu m$ and $F_M=1344$ GHz.

The accelerator according to the invention being linear allows to vary along the linear way of acceleration parameters, which as for example the width of the irises, so as to fit with the mass, and the speed of the particles which vary along the axis 3.

With a circular way of acceleration this adaptation is not possible.

I claim:

1. An electron beam device comprising an evacuated enclosure housing an electron gun for providing an annular electron beam which travels along a beam axis $O_z$ with a non-zero component of angular velocity, means downstream along the beam axis for accelerating the angular velocity of the beam, and resonator means along the beam axis downstream of the accelerating means for utilizing the accelerated beam characterized in that the accelerating means comprises a delay line which is to be supplied with high frequency electromagnetic energy for establishing along the beam axis an electromagnetic field whose electric field component is primarily longitudinal in the direction of the beam axis and means for establishing a magnetostatic field which is coextensive with the delay line and whose strength along the delay line increases with increasing distance, whereby the interaction of said longitudinal electric field component and said electron beam compensates for an increasing magnetostatic field results in an increase in the angular velocity of the beam.

2. The device of claim 1 in which the delay line is an iris-loaded wave guide.

3. The device of claim 1 in which the rate of increase of the magnetostatic field and the length of the delay line are such that an electron describes about ten orbits within the delay line.

4. The device of claim 1 in which the strength of the longitudinal electric field component and the strength of the magnetostatic field are such that the electron beam maintains essentially a constant axial velocity along the delay line.

5. The device of claim 1 in which the utilization means comprises a structure resonant at a frequency which is substantially higher than that of the supplied high frequency energy and means for maintaining a substantially uniform magnetostatic field along the beam axis substantially coextensive with said resonator.

6. The device of claim 5 in which the resonant structure includes a pair of parallel reflecting members between which the beam passes.

7. The device of claim 6 wherein each reflecting member has a semi-reflecting zone and a reflecting zone, the reflecting zone of each being opposite the semi-reflecting zone of the other and wherein two inclined reflecting means cooperate with the pair of reflecting members to deflect the radiation fro the resonant structure out of the vacuum enclosure and in the direction of the beam axis.

8. An electron beam device comprising within an evacuated enclosure, an electron gun for providing a helically rotating annular electron beam flowing along a beam axis, means for creating an magnetostatic field of increasing strength along the beam axis for increasing the angular velocity of the electrons in the beam, means for maintaining a high frequency longitudinal electric field along the beam axis in the region of increasing magnetostatic field for maintaining substantially constant the axial velocity of the electrons in the beam as their angular velocity increases, and resonant means downstream through which the electron beam of increased angular velocity passes wherein energy of a frequency higher than that of said longitudinal electric field is produced.

* * * * *